US009316392B2

(12) United States Patent
Bettinzoli

(10) Patent No.: US 9,316,392 B2
(45) Date of Patent: Apr. 19, 2016

(54) GAS BURNER HAVING MEANS FOR REVERSIBLY FIXING THE COVER

(75) Inventor: Angelo Bettinzoli, Concesio (IT)

(73) Assignee: SABAF S.P.A., Ospitaleto (IT)

( * ) Notice: Subject to any disclaimer, the term of this patent is extended or adjusted under 35 U.S.C. 154(b) by 1554 days.

(21) Appl. No.: 10/557,255

(22) PCT Filed: May 16, 2003

(86) PCT No.: PCT/IT03/00294

§ 371 (c)(1),
(2), (4) Date: Dec. 8, 2005

(87) PCT Pub. No.: WO2004/102072

PCT Pub. Date: Nov. 25, 2004

(65) Prior Publication Data

US 2006/0275725 A1 Dec. 7, 2006

(51) Int. Cl.
*F23D 14/06* (2006.01)

(52) U.S. Cl.
CPC ..... *F23D 14/06* (2013.01)

(58) Field of Classification Search
USPC ..... 431/354, 253; 126/41 R, 39 R
See application file for complete search history.

(56) References Cited

U.S. PATENT DOCUMENTS 2,386,113 A 10/1945 Harper et al.
2,486,278 A * 10/1949 Harper ..... 239/559
2,640,531 A 6/1953 Lamar
2,904,373 A * 9/1959 Dowdy et al. ..... 403/316
3,324,925 A * 6/1967 McLaren ..... 239/434
3,564,879 A * 2/1971 Bennett ..... 70/232
5,152,276 A * 10/1992 Brock et al. ..... 126/39 E
6,106,052 A * 8/2000 Shaw ..... 296/167
6,244,263 B1 * 6/2001 Schlosser et al. ..... 126/39 R

FOREIGN PATENT DOCUMENTS

FR 2 618 881 A 2/1989

OTHER PUBLICATIONS

International Search Report of PCT/IT03/00294, mailed Jan. 27, 2004.

* cited by examiner

*Primary Examiner* — Kenneth Rinehart
(74) *Attorney, Agent, or Firm* — Nixon & Vanderhye P.C.

(57) ABSTRACT

Gas burner (1) for a cooking hob (14) comprising: a burner cup (2) constrained to the cooking hob, onto which at least one burner body (3) is mounted, and at least one superior cover (5), which can be removably coupled to said burner body, as well as at least one annular flame diffuser (4), designed to produce at least one flame crown. The burner is also provided with means (9, 9', 10) for reversibly fixing the superior cover to the burner cup. The reversible fixing means comprise at least one male part (9, 9') integral to the cup and at least one female part (10) integral to the cover, or vice-versa, in which the male part can be inserted into the female part and is movable within the female part between at least one reciprocal holding position and at least one reciprocal release position.

19 Claims, 2 Drawing Sheets

GAS BURNER HAVING MEANS FOR REVERSIBLY FIXING THE COVER

This application is the US national phase of international application PCT/IT2003/000294, filed 16 May 2003, which designated the U.S., the entire content of which is hereby incorporated by reference.

FIELD OF THE INVENTION

The present invention relates to a gas burner for a cooking hob, of the type comprising a burner body, an annular flame diffuser, possibly integral with the body of the burner, a lower cup and at least one superior cover, which can be removably coupled to the burner cup.

A "cooking hob" is here, and in what follows, understood to be any substantially flat support, either being completely, or partly integral to a range, realised in any suitable material, and provided with at least one housing into which it is possible to mount an atmospheric type gas burner.

TECHNICAL BACKGROUND

Previous known gas burners for cooking hobs are built by means of assembling three main components placed one on top of the other: a cup, constrained to the cooking hob and extending to some extent below the said hob, a central burner body, provided with, or functionally linked to, at least one annular chamber having as its lateral wall an annular flame diffuser, and a superior cover which usually defines the upper wall of the said annular chamber.

The burner cup, fluidically connected to the combustible gas supply by means of a flexible supply pipe, contains an injector for the said combustible gas, whereas the central body is usually fitted with a Venturi tube, possibly radial, designed to mix the combustible gas with the atmospheric air (primary air), taken from either above, or below the cooking hob. The cup and the burner body can be fixed together in a stable way, for example, by being bolted together, otherwise they can just be reciprocally juxtaposed, so as to make it easy for the burner body to be removed from the cup, as is for example necessary during maintenance operations to the burner.

The superior cover can also be mounted to the central burner body in a substantially non-removable way, by means of threaded elements, or alternatively in a removable way, by simply resting on it, to allow the central body to be cleaned and maintenance work to be carried out. There are also some known intermediary solutions, where the cover is fixed to the burner body in a transitory way, by means of a reversible mechanical coupling, for example, of the bayonet type, or in which the cover is reversibly constrained to the cup by elastic means (for example, a clip or elastic clamp), so as to hold the central burner body between the cover and the cup.

Such reversible solutions for fixing the cover can prove useful, above all, in vehicles, such as campers, caravans and boats, where having the cover simply rest on the central burner body may not be enough to stop the cover from becoming dislodged from the central burner body while the vehicle is moving, resulting in it damaging the cooking hob, or making it impossible to use the same burner; and where other solutions with the stable coupling between cover, body and cup results in complicated cleaning and maintenance operations of the said burner.

Moreover, being able to couple the cover only in a transitory way to the same central body, or to the cup of the same burner, as opposed to the other solutions, affords both easy partial maintenance of the outside of the burner, which does not require removal of the cover, and complete maintenance operations involving disassembling the entire burner.

The U.S. Pat. No. RE 22,877 (HARPER), concerning a burner with two concentric flame crowns, teaches to couple a cover, with an annular flame diffuser, and a burner body by means of inserting some fins, which the cover is provided with, in corresponding grooves provided in the burner body. The grooves have some widened portions which the fins can be inserted into and removed from, and some portions designed to hold said fins. By supplying the combustible mixture directly to the burner body and without it having to be flush-mounted into a cooking hob, the HARPER burner does not foresee, nor suggest, the use of a burner cup, and therefore it does not describe how to couple three or more components of the burner contemporaneously in a reversible way.

The French application for a patent FR 2.618.881, in the name of MADEC-MATER, describes a flush-mountable burner comprising a lower cup onto which are coupled one or more intermediate coaxial bodies, provided with a possible annular flame diffuser, and a superior cover that encloses the burner. The superior cover is fixed in a reversible way to the burner cup by means of a threaded pin (see FIG. 5 of the MADEC-MATER patent), whose head holds the cover, and whose foot is shaped so as to be locked in a releasable way inside special elastic holding means (clip), which said burner cup is provided with. The central burner body is further held down to the cover by means of a nut that is screwed onto the pin.

Even though the application FR 2.618.881 envisages the use of a burner comprising numerous parts placed one on top of the other, and held together by reversible fixing means, the use of elastic means for holding the shaped foot of the pin, nevertheless, entails complications during production and, by becoming permanently deformed with use, the elastic elements or clips may no longer be of use in holding the pin, giving rise to the diminished effectiveness of such reversible fixing means in time.

Furthermore, the MADEC-MATER patent does not envisage a loose coupling between the cover and the central burner body when the cover is disconnected from the cup, in this way forcing the user to loosen the nut to be able to separate these two elements during complete maintenance operations to the burner.

One purpose of the present invention is to provide a gas burner of the type comprising a lower cup, at least one central body, an annular flame diffuser, preferably integral to the central body, and a superior cover, interconnected each other by means of reversible fixing means, that is at the same time easy to produce, effective in its functioning and practical to use.

Another purpose of the present invention is that of providing a gas burner of the type described above, on whose internal, or only external parts the user can easily carry out maintenance operations.

A further purpose of the present invention is that of producing a gas burner that is suited to being fitted to a cooking hob installed in vehicles; that is safe to use and whose reversible fixing means do not present problems of reliability and effectiveness.

SUMMARY OF THE INVENTION

The gas burner for a cooking hob, according to the present invention, comprises a burner cup, constrained to the cooking hob, onto which is mounted at least one burner body, and at least one superior cover that can be removably coupled to said burner body, as well as at least one annular flame diffuser designed to produce at least one crown flame. The burner is, furthermore, provided with means for reversibly fixing the superior cover to the burner cup, the intermediate body being held between the cover and the cup. The means for reversibly fixing the cover to the cup comprise at least one male part integral to the cup and at least one female part integral to the cover, or vice-versa, wherein the male part can be inserted into the female part, and can be moved inside the female part between a reciprocal holding position and a reciprocal release position.

The use of a mechanical coupling, acting by interposition of parts, and devoid of elastic parts, ensures the reliability and effectiveness of the reversible fixing means of the burner, which is also structurally simple, given the absence of elastic components, such as tangs and springs, which, moreover, make assembly difficult.

Furthermore, according to a preferred aspect of this invention, such reversible fixing means are of the bayonet type, and include at least one pin, integral to the burner cup, having a shaped head that is designed to fit into a corresponding housing made in the lower portion of the said cover. The central burner body, moreover, has one or more holes, or housings, into which the pin and its head are free to move.

With this preferred form of the invention such a structure has proved to be very simple to produce and extremely effective to use, given the simple steps that the user needs to follow to assemble and to disassemble the burner.

In another preferred embodiment of the present invention, the pin consists of a screw, or other threaded element, and is made integral to the burner cup by being screwed into a corresponding housing, having an internal thread, made in said cup. The housing for the head of the screw, made in the superior cover, comprises a groove having at least one enlarged release section to allow the shaped head of the screw to enter and be removed.

BRIEF DESCRIPTION OF THE DRAWINGS

A preferred form of the present invention will now be described, which illustrates a non-limiting example of embodiment thereof, with the aid of the enclosed figures, in which.

DETAILED DESCRIPTION OF SOME PREFERRED EMBODIMENTS OF THE INVENTION

Figure 1:
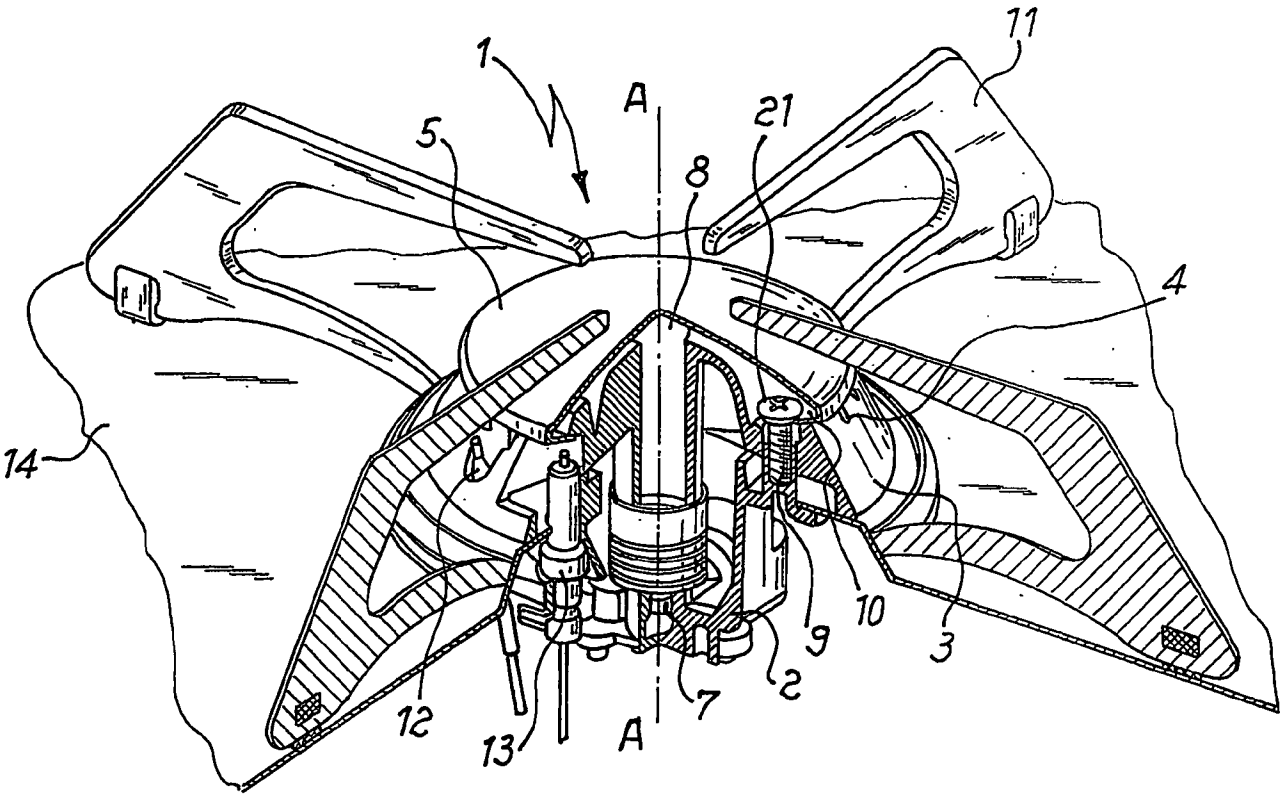
FIG. 1 is a partially sectioned perspective view of a burner according to the present invention.
Figure 2:
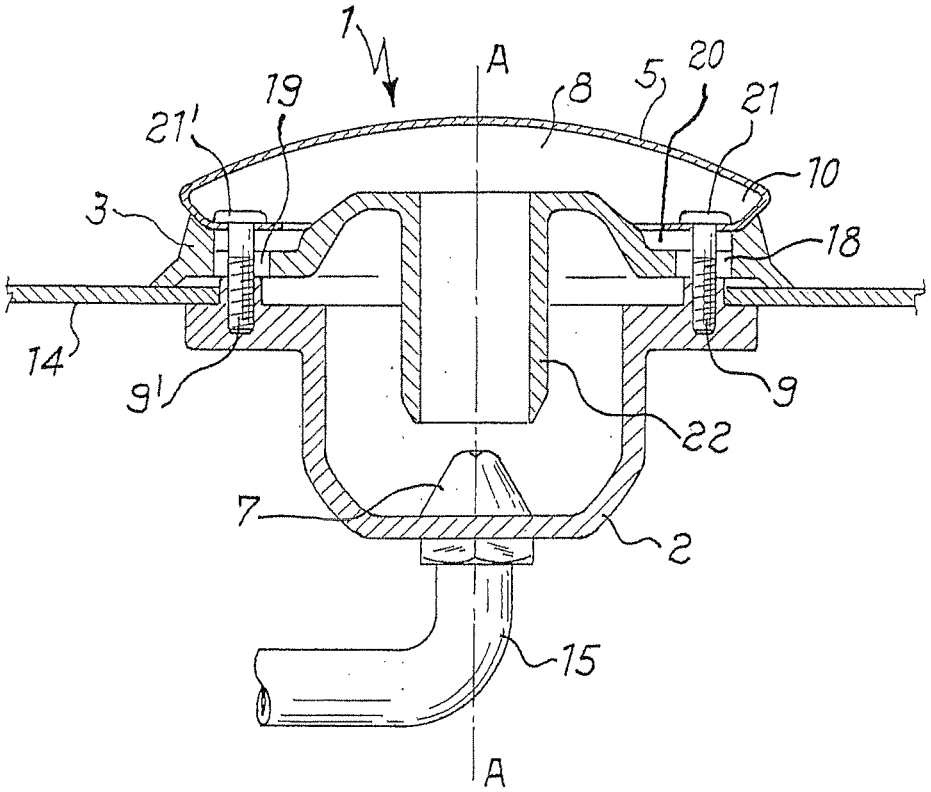
FIG. 2 is a simplified section view of the burner illustrated in FIG. 1.
Figure 3:
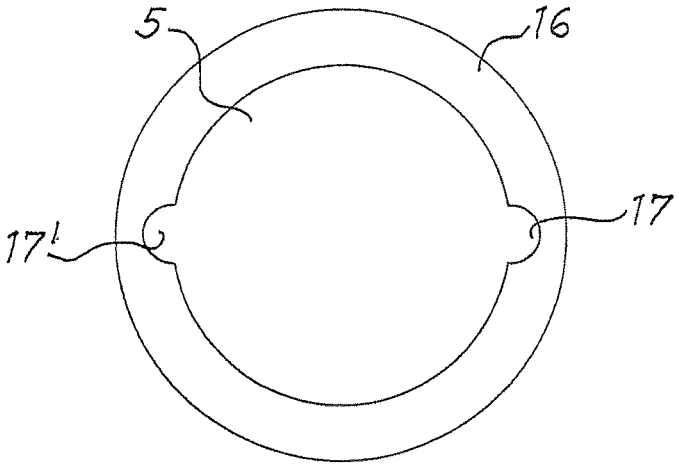
FIG. 3 is a bottom plan view of the cover of the burner illustrated in FIG. 1.

With reference to the figures as a whole, the gas burner 1, according to the present invention, comprises a cup 2, constrained to a cooking hob 14, onto which is coupled a central burner body 3 which, in the embodiment illustrated, has an annular flame diffuser 4 designed to produce at least one flame crown. A removable superior cover 5 is placed on the central burner body 3, so as to close this latter, and is constrained directly to the cup 2 by means of reversible fixing means 9, 10, which also have the function of holding the central burner body 3 in position between the said cup 2 and the removable cover 5.

The annular flame diffuser 4 could, as an alternative to the one illustrated, be produced as a separate component interposed between the cover 5 and the central burner body 3, or it can be produced integral to the said cover 5.

The reversible fixing means, according to the present invention, comprise at least one male part 9, integral to the cup 2, and at least one female part 10, integral to the cover 5, or vice-versa. The male part 9 may be slidingly inserted into the female part 10 and it is movable inside this latter between at least one reciprocal holding position 16 and one reciprocal release position 17.

The mechanic coupling defined by the interference fit, in specific reciprocal positions, of at least one male part 9 with at least one female part 10 assures an effective reversible fixing for the burner 1, that is both structurally simple and easy to use.

In more detail, the burner 1 illustrated in the embodiment shown comprises a cup 2 provided with at least one injector 7 of a combustible gas, for example methane flowing, according to known techniques, from a supply source and adjustably supplied to the burner by means of a connection pipe 15 and a cock, not shown. The cup 2, as will be shown in more detail later in this description, is constrained to the cooking hob 14, and it extends below thereto, thanks to the coupling of shaped parts on the burner body 3 with shaped parts on the same cup 2, that clamp portions of the same cooking hob 14, when the cover 5 is fixed to the cup 2.

Alternative methods and means for constraining the cup 2 to the cooking hob 14, for example, by means of bolts or elastic clamps (clips), are well known in the art and they don't directly concern the object of the present invention.

The central body 3 of the burner 1 simply rests on the cup 2 and is provided with, according to known technical design, a Venturi tube 8 to mix the combustible gas with primary air. Advantageously, the Venturi tube can be of the radial type, as shown in FIG. 1, even if other embodiments of such a Venturi tube, or its absence in the central body 3, do not affect the scope of protection of the present invention.

Similarly, the flow of the primary air can equally be obtained from above the cooking hob 14 or from below this latter, without departing from the innovative object of the present invention.

The central burner body 3, in the particular embodiment shown, defines an annular chamber 20, which is placed downstream of the Venturi tube 8, and it is provided with differently shaped slits, open outwards, which constitute an annular flame diffuser 4, designed to create a circumferential flame crown. The annular flame diffuser 4, as mentioned, could, however, also be produced from a separate body, held between the cover 5 and the burner body 3, and forming the outer side wall of the same chamber 20.

The upper wall of the annular chamber 20, in the burner in FIG. 1, is furthermore constituted by the underside face of the cover 5, which is shaped as to enable an initial coupling with the burner body 3, by way of corresponding (juxtaposable) parts resting together. The burner 1 also has, as is usual in the art, a grill 11 to support frying pans or saucepans, a safety thermocouple 13 and an ignition plug 12.

According to the present invention, as already described, the burner 1 is provided with reversible fixing means 9, 10, which in the burner 1 illustrated, are of a bayonet type, i.e. of the type that foresee an initial reciprocal coupling phase of at least one male part entering a female part 10, according to an axial direction of connection, followed by a successive fixing phase of the male part 9 and the female part 10, which is achieved by relatively rotating the male part 9 with respect to the female part 10—thanks to the fact that the female part 10 and the male part 9 are shaped in such a way as to allow for them to have reciprocal free coupling positions and reciprocal holding positions.

In more detail, the reversible fixing means of the burner 1 comprise a pair of pins 9, 9', diametrically opposed with respect to the A-A axis of the burner and substantially extending in a parallel direction to the said axis, which have a shaped head 21, 21' designed to fit into, and be removed from inside, a corresponding housing 10. The pins 9, 9' and the housing 10 constitute respectively the male and the female parts of the temporary means of fixing described above.

In the particular embodiment of the burner 1 according to the present invention here illustrated, each pin 9, 9' is integral to the cup 2, whereas the housing 10 is cut along the underside face of the cover 5, and is advantageously constituted of a groove 10 defined by a folded edge 16 of the same cover 5 and having a number of wider release sections 17, 17' corresponding to the number of pins 9, 9'. In the illustrated burner 1, the widened sections 17, 17', for releasing the heads 21, 21' of the pins 9, 9', are diametrically opposed each other, so that they can be aligned with the pins 9, 9' in two relative angular positions of the cover 5 with respect to the same pins 9, 9'.

The widened sections 17,17' are, as already mentioned, large enough to enable the heads 21, 21' of the pins 9, 9' to enter into the groove 10, while the edge 16 extends towards the A-A axis of the burner 1 so as to prevent the said heads 21, 21' from being dislodged from said groove 10. Advantageously, the pins 9, 9' can also be threaded in order to be made integral to the cup 2 by being screwed into specially made threaded holes (internal threads) made into the cup 2.

Alternatively, in a not shown embodiment, the pins 9, 9' and the cup 2 can be made as a whole or they can be made integral to the cup 2 by way of welding.

The central body 3 can have a number of housing or slots 18, 19, corresponding to the number of pins 9, 9', into which the pins 9, 9' can be freely inserted in a sliding way, in order for the central body 3 to be held axially between the cover 5 and the cup 2. Advantageously, the housings or slots 18, 19 of the body 3 can be just the right size to enable not only the stem of the pins 9, 9', but also the heads 21, 21' of said pins, to pass through, since holding the burner body 3 in an axial direction (i.e. a parallel direction to the A-A axis of the burner), as shown in the figures, is entrusted to the mechanical connection between the cover 5 and the cup 2, without the pins 9, 9' affecting the holding down of the burner body 3. In an alternative embodiment of the burner according to the present invention, the pins 9, 9' can also be external to the central burner body 3, and therefore this latter can have no parts shaped to be joined to the above-mentioned pins 9, 9'.

Assembly and disassembly of the burner 1 here illustrated, first takes place by screwing the pins 9, 9' into the internal threads made in the cup 2 of the burner, in order to make them integral to the cup 2, then positioning the cup 2 in a hole made in the cooking hob 14, and then possibly fixing the cup 2 to the cooking hob by way of known means, such as threaded elements or clips. Following this, the central body 3 is assembled coaxially on the cup 2, with juxtaposed parts, by inserting and sliding the pins 9, 9', and the respective shaped heads 21, 21', inside the slots 18, 19 that said burner body 3 is provided with.

The engagement of the pins 9, 9' into the slots 18, 19 ensures that the body 3 is perfectly centered with respect to the cup 2, and therefore this means the injector 7 will be perfectly aligned with the vertical access duct 22 of the Venturi tube 8 that is present in the same burner body 3.

Successively, the cover 5 is placed on the body 3, while first making sure that the widened sections 17, 17' of the groove 10 correspond with the heads 21, 21' of the pins 9, 9', before inserting the said heads into the groove 10 of the widened sections 17, 17', and finally turning the cover 5 with respect to the pins 9, 9', so that the shaped heads 21, 21' move inside the groove 10 to coincide with the holding wall (edge) 16 of the same groove 10.

In case that known means are not used to fix the cup 2 to the cooking hob 14, the length of the pins 9, 9', and the conformation of the burner body 3 as well as of the cup 2, can give rise to the entire burner 1 being coupled to the cooking hob 14, as illustrated in FIG. 1, thanks to the interposition, between the burner body 3 and the cup 2, of the edge of the mounting hole for the cup 2 of the same surface 14. When the burner body 3 and the cup 2, which have appropriately shaped regions, are constrained together by means of the pins 9, 9' and the groove 10, said edge of the cooking hob 14 is then stably clamped between the said shaped regions of the aforementioned burner body 3 and the cup 2.

In order to disassemble the said burner 1, it is necessary to repeat the operations listed above in the reverse order.

The possibility of obtaining a simple and effective reversible fixing of the cover 5 to the cup 2, and therefore of the entire burner 1, by the fixing means 9 and 10, enables such a burner to be mounted extremely safely on different types of vehicle, even when the burner is used in vehicles that are moving (as for example, in ships or trains), and at the same time it allows the user to quickly disassemble the said burner 1, should it be necessary to carry out thorough cleaning and maintenance operations.

The use of fixing means 9, 10, acting through the interposing of parts, and therefore without elastic elements, guarantees the substantial absence of functional decay in time associated with such fixing means.

Moreover, the reversible fixing means 9, 10, allow the user to simply clean the outside of the burner 1 without having to remove the cover 5 from the burner body 3, while keeping the said burner 1 structurally simple and, therefore, economical to produce.

The invention claimed is:

1. Gas burner for a cooking hob comprising a burner cup, constrained to said cooking hob, onto which rests at least one burner body, at least one cover which can be removably coupled to said burner body, and at least one annular flame diffuser configured to produce at least one flame crown, said burner body, with said at least one annular flame diffuser, being interposed between said burner cup and said at least one cover, the burner cup, the burner body, the flame diffuser and the at least one cover being interconnected to each other only by means for reversibly fixing said at least one cover onto said burner cup, wherein said reversible fixing means comprise at least one male part integral to said burner cup and at least one female part integral to said at least one cover, or vice-versa, in which said male part may be inserted into the female part and is moveable between at least one reciprocal holding position and at least one release position once the male part is inserted into the female part, said burner body, with said flame diffuser, being held in position between said at least one cover and said burner cup by said reversible fixing means.

2. Burner according to claim 1, wherein said reversible fixing means are of the bayonet type.

3. Burner according to the claim 2, in which said male part of the reversible fixing means comprises at least one pin having a shaped head designed to fit into a corresponding housing which constitutes the female part.

4. Burner according to claim 3, in which said at least one pin extends along an axis parallel to the axis of symmetry of said burner.

5. Burner according to claim 3, in which said at least one pin is integral to said cup of the burner.

6. Burner according to claim 3, in which said at least one pin is a screw screwed into a corresponding internal thread made in said cup of the burner.

7. Burner according to claim 3, wherein said burner body comprises one or more slots or housings into which said at least one pin can freely slide.

8. Burner according to claim 3, in which said housing comprises a groove into which said shaped head of said at least one pin can be housed, said groove being provided with at least one widened release section that provides the at least one release position, to allow said shaped head to enter and leave.

9. Burner according to claim 1, wherein said at least one annular flame diffuser is formed in one piece with said burner body.

10. Burner according to claim 1, in which said burner body defines at least one annular chamber joined to said annular flame diffuser, the upper wall of said annular chamber being constituted, at least partially, by the underside face of said cover.

11. Burner according to claim 1, wherein the reversible fixing means prevents the cover from being lifted off the burner cup when the male part and the female part are in the reciprocal holding position.

12. Burner according to claim 1, wherein the male part is moveable between the at least one reciprocal holding position and the at least one release position by rotating the burner cup and the at least one cover with respect to each other.

13. Burner according to claim 8, wherein the groove is defined by an inward edge of the at least one cover.

14. Burner according to claim 8, wherein the at least one widened release section comprises two widened release sections that are diametrically opposed to each other.

15. Burner according to claim 10, wherein the burner body comprises a venturi tube and the at least one annual chamber is downstream of the venturi tube.

16. Burner according to claim 1, wherein the burner cup is a one piece unitary structure.

17. Burner according to claim 1, wherein the at least one cover is a one piece unitary structure.

18. Burner according to claim 1, wherein the burner cup and the at least one cover are each a one piece unitary structure.

19. Burner according to claim 15, wherein the at least one burner body comprises an access duct aligned with an injector connected to the burner cup that directs fuel from the injector into the venturi.

* * * * *